US007478915B1

(12) United States Patent
Pedersen

(10) Patent No.: US 7,478,915 B1
(45) Date of Patent: Jan. 20, 2009

(54) MAINTENANCE ENHANCED ILLUMINATION ASSEMBLY

(76) Inventor: Charles E. Pedersen, 1380 SW. 57 St., Plantation, FL (US) 33317

( * ) Notice: Subject to any disclaimer, the term of this patent is extended or adjusted under 35 U.S.C. 154(b) by 65 days.

(21) Appl. No.: 11/500,803

(22) Filed: Aug. 8, 2006

Related U.S. Application Data

(60) Provisional application No. 60/785,216, filed on Mar. 24, 2006.

(51) Int. Cl.
*F21S 8/00* (2006.01)

(52) U.S. Cl. ..... 362/145; 362/382; 362/427; 362/812; 362/431; 362/430; 362/233; 362/238

(58) Field of Classification Search ..... 362/145, 362/427, 812, 431, 430, 238, 233, 382
See application file for complete search history.

(56) References Cited

U.S. PATENT DOCUMENTS 4,372,071 A * 2/1983 Vicino ..... 40/624
4,954,935 A 9/1990 Hammond
5,233,772 A * 8/1993 Bergeron et al. ..... 40/503
5,517,393 A * 5/1996 Townsend et al. ..... 362/233
5,660,453 A * 8/1997 Lewis ..... 362/551
5,818,640 A 10/1998 Watanabe
5,934,795 A 8/1999 Rykowski
2003/0137840 A1 7/2003 Citron
2004/0090785 A1 * 5/2004 McInnis ..... 362/362

* cited by examiner

*Primary Examiner*—Stephen F Husar
*Assistant Examiner*—Jessica L McMillan
(74) *Attorney, Agent, or Firm*—Alvin S. Blum

(57) ABSTRACT

An illumination assembly allows quick and easy access to light fixtures that are mounted extended far enough away from a catwalk of a lighted sign such as a billboard as to be inaccessible to a worker on the catwalk. An elongate tubular member is pivotally mounted on a support affixed to the catwalk. A light fixture is mounted on the distal end of the member. A control mechanism enables the member to be fixed in extended position for use in illuminating the sign. The control mechanism enables the member to pivot to a position where the light fixture is adjacent the catwalk, for changing the light bulb or other maintenance. The control mechanism is accessible from the catwalk.

3 Claims, 6 Drawing Sheets

FIG. 2
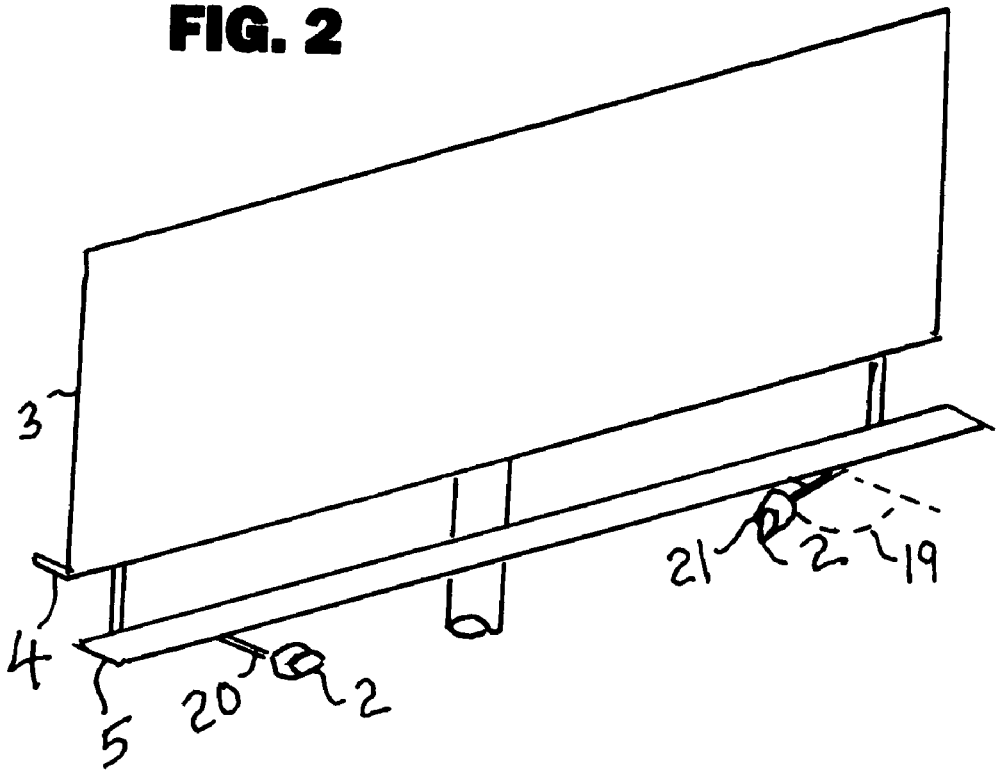
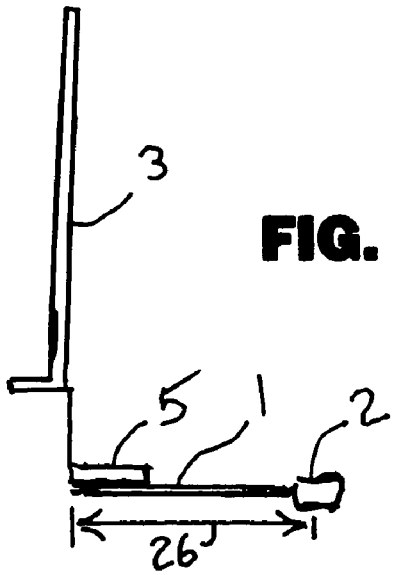
FIG. 1

MAINTENANCE ENHANCED ILLUMINATION ASSEMBLY

Applicant claims priority of provisional patent application Ser. No. 60/785,216 filed Mar. 24, 2006.

FIELD OF THE INVENTION

This invention relates to apparatus for mounting and maintaining the lights of illuminated billboards, traffic displays and the like.

BACKGROUND OF THE INVENTION

Outdoor displays such as, but not limited to, billboards, building signs, and traffic displays, are often provided with electric lights. These are generally high intensity light assemblies that may weigh about sixty pounds. Billboards are generally provided with a catwalk at the display that is easily accessible. However, the lights are mounted many feet away from the surface being illuminated, too far to reach from the catwalk. When a bulb burns out, on average of once every 18 months, they are hard to reach for replacement. The worker may have to resort to a "cherry picker" crane to safely replace the bulb or make other repair. The maintenance costs involved with conventional light assemblies are consequently very high. U.S. Pat. No. 5,517,393 issued May 14, 1996 to Townsend discloses a rotatable conveyor assembly to move the lights to one side for maintenance of lights over a roadway.

SUMMARY OF THE INVENTION

It is accordingly an object of the invention to provide an illumination assembly that is simple, convenient and safe to install and maintain. It is another object that the assembly be inexpensive to construct for retrofitting existing displays as well as in construction of original equipment. It is yet another object that the assembly not introduce complexity that may further add maintenance costs. It is yet another object that the invention provide safe and easy access to the bulbs without expensive apparatus.

These and other objects, features, and advantages of the invention will become more apparent when the detailed description is studied in conjunction with the drawings, in which like elements are designated by like reference characters in the various drawing figures.

BRIEF DESCRIPTION OF THE DRAWINGS

FIG. 1 is a side elevation view of a billboard with assembly of the invention.

FIG. 2 is a perspective view of the billboard with one light swung in for maintenance.

DETAILED DESCRIPTION OF PREFERRED EMBODIMENTS

Figure 3:
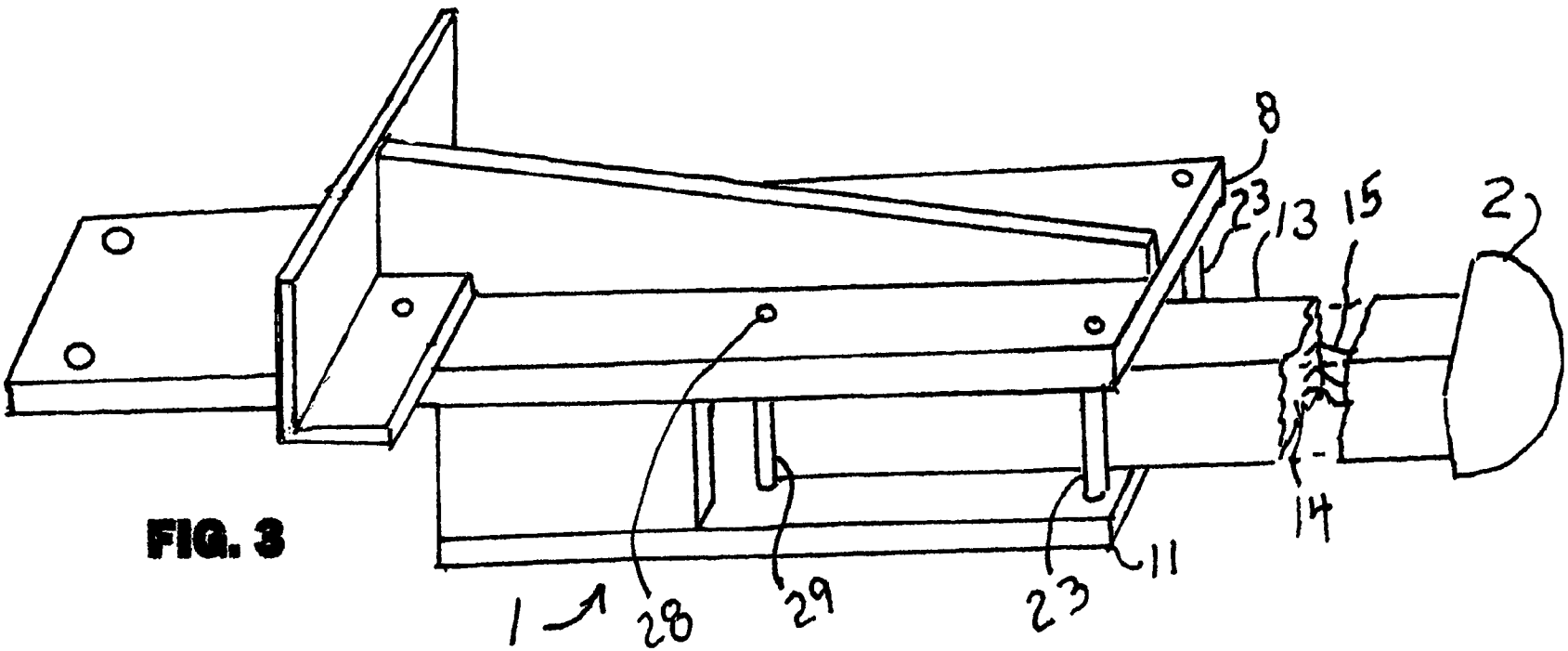
FIG. 3 is a perspective view of the assembly of the invention.
Figure 4:
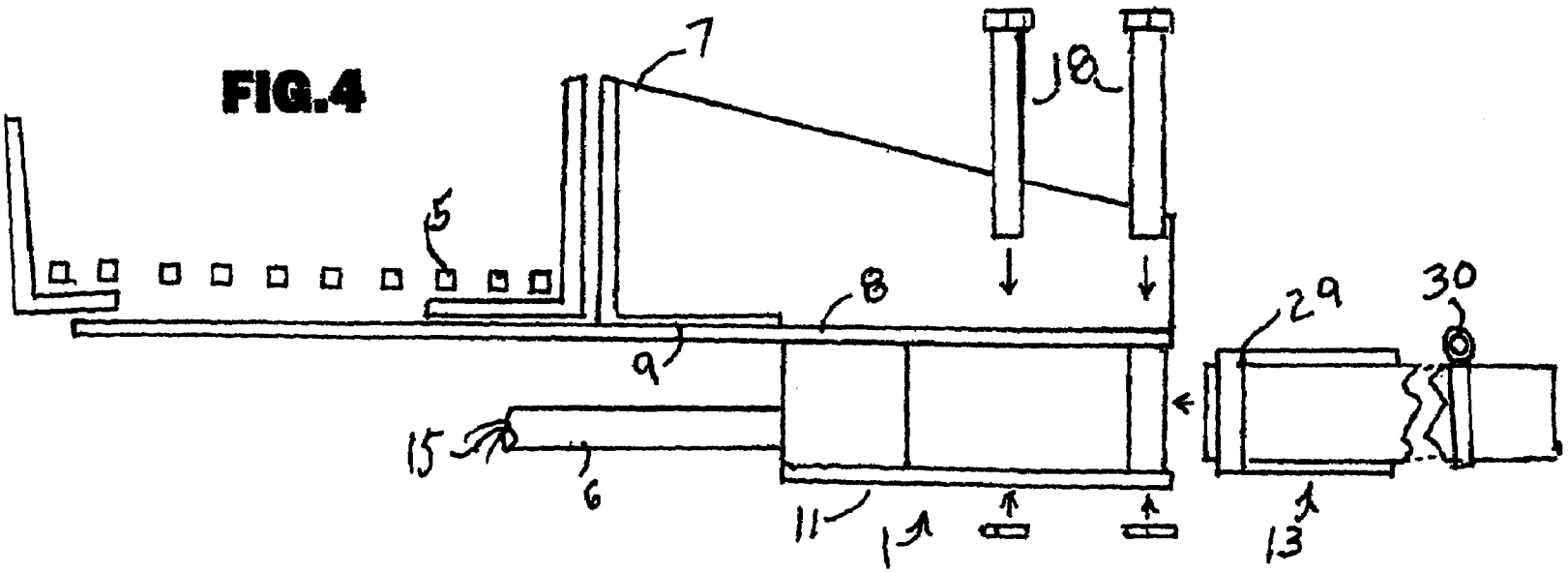
FIG. 4 is an exploded side elevation view of the assembly of FIG. 3.
Figure 5B:
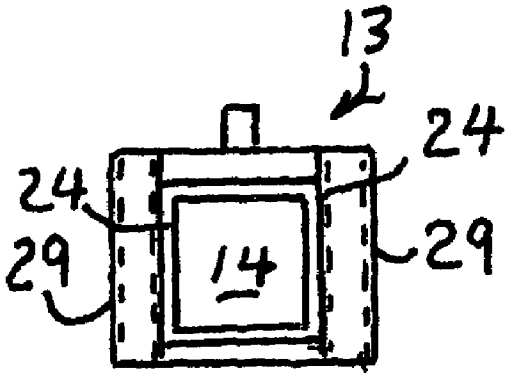
FIG. 5B is a front elevation view of the tubular member.
Figure 5A:
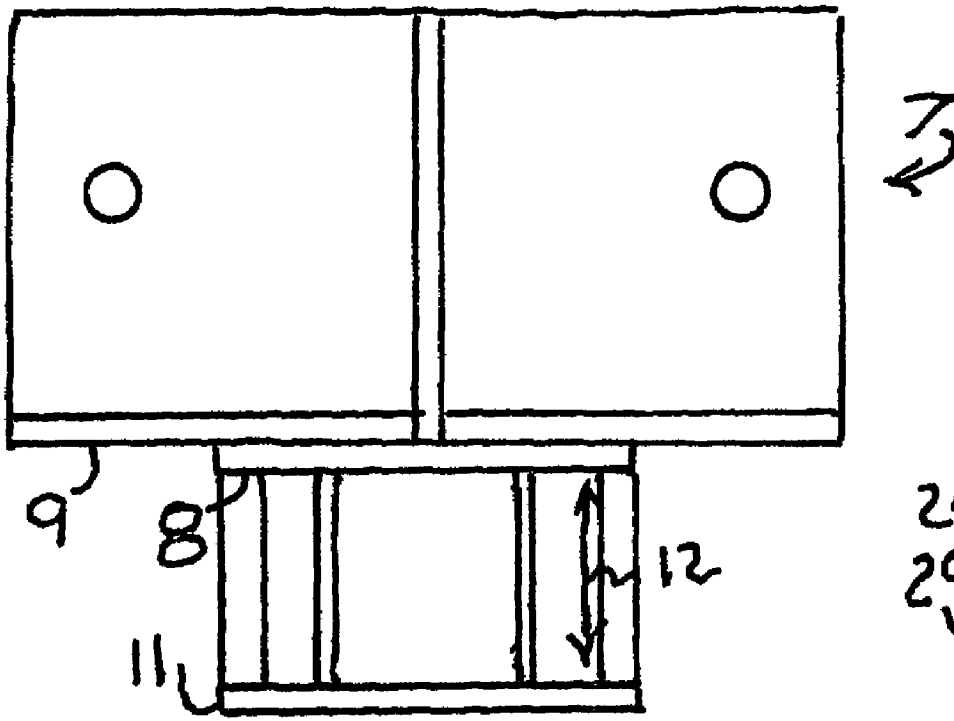
FIG. 5A is a front view of the assembly of FIG. 3 with tubular member removed.

Referring now to drawing FIGS. 1-7, an illuminated sign such as a traffic sign or a billboard has a surface 3 to be illuminated by one or more light fixtures 2. The sign is held high above the ground in a rigid frame 4. A catwalk 5 is affixed to the frame to enable workers to work on the sign. Light fixtures 2 powered by electric power conductor 6 in a conduit are positioned at a first distance 26 from the sign to illuminate the sign at night. The light fixtures are mounted on pipes affixed to the catwalk in the prior art. Because the fixtures are many feet beyond the catwalk, they cannot be safely reached by a worker on the catwalk. To reach the light fixture, a worker must climb a ladder resting on the fixture support pipe, which may not safely support such a load. Alternatively, a crane or other machine that can safely elevate the worker must be employed. The instant invention provides an illumination assembly 1 that holds the light fixture 2 securely in position at the required first distance 26 from the surface to be illuminated. It will remain in that position during use. The assembly 1 enables a worker on the catwalk to first release the means holding the fixture in the extended position and then enable the worker on the catwalk to rotate the fixture through a horizontal arc 19 to a position adjacent the catwalk, as best seen at 2' of FIG. 2, so that the worker can safely replace a bulb or other maintenance while on the catwalk. The assembly includes a bracket 7 that is bolted or welded to the catwalk. A planar upper element 8 is affixed to the underside 9 of the bracket. A planar lower element 11 is affixed parallel to the upper element and below it to define a first space 12 therebetween. An elongate tubular member 13 has an internal passage 14 for the electric wire 15 connecting the electric power conductor 6 to the light fixture. The tubular member 13 has a distal first end 16 for affixing to the light fixture. The member 13 has a proximal second end 17 that is received in the space 12. The end 17 is held securely in the space with the light fixture fully extended for use by a pair of bolts 18 that pass through apertures 27 in the upper and lower elements and through sleeves 29 affixed to the sides 24 of the member. Either one of these bolts will serve as an axle when the other bolt is removed to rotate the member for maintenance. A second pair of fasteners, 23 pass through apertures 28 in upper and lower elements and impinge against the sides 14 of the member to resist rotation of the member. These locking fasteners further maintain the fixture in the first, or extended position 20. These means for releasably preventing rotation will hold the fixture extended even in high winds.

To rotate the member 13 to the second, or maintenance position 21, one of the axle bolts 18 and a locking fastener 23 on the opposite side are removed. The member is then free to rotate in the horizontal arc 19 to position the fixture adjacent to the catwalk. A ring 30 on the member may be provided to engage with a long hook to facilitate rotation of the member. The ring 30 may be welded in place or may be affixed by other means well known in the art. The ring 30 may also be used to secure the fixture adjacent the catwalk in a storm. This system enables the same structure to be used to rotate clockwise or counterclockwise as required.

Figure 8:
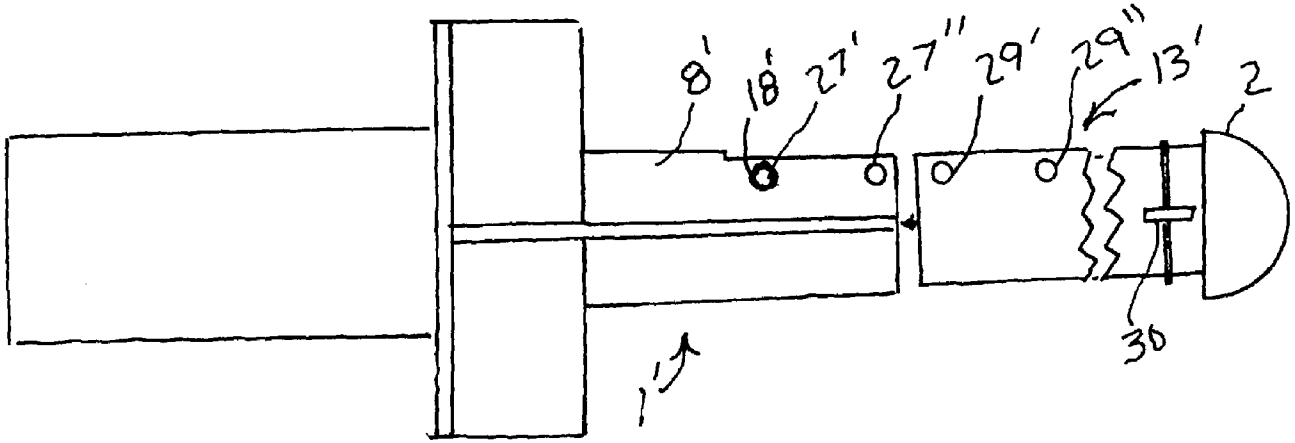
FIG. 8 is a top view of another embodiment of the invention.
Figure 6:
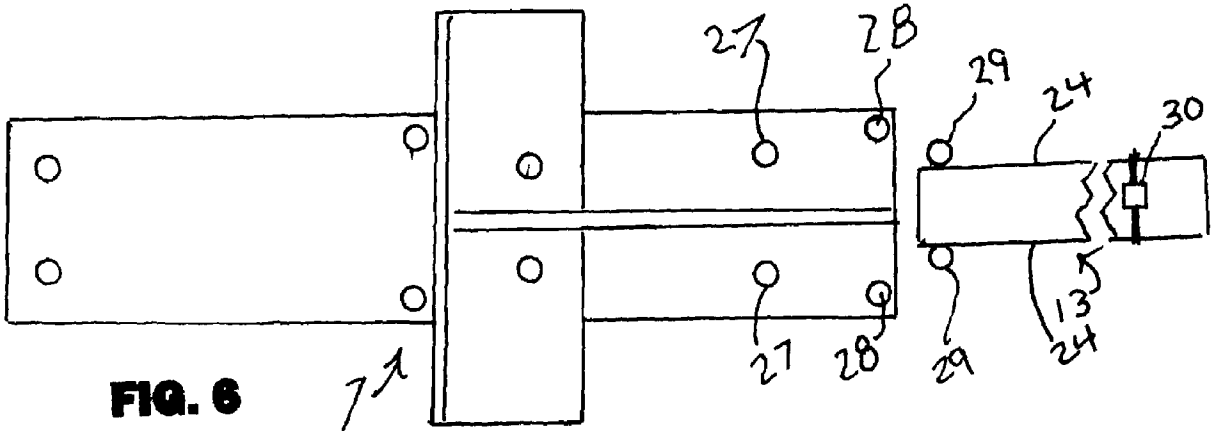
FIG. 6 is an exploded top view of the assembly of FIG. 3.
Figure 7:
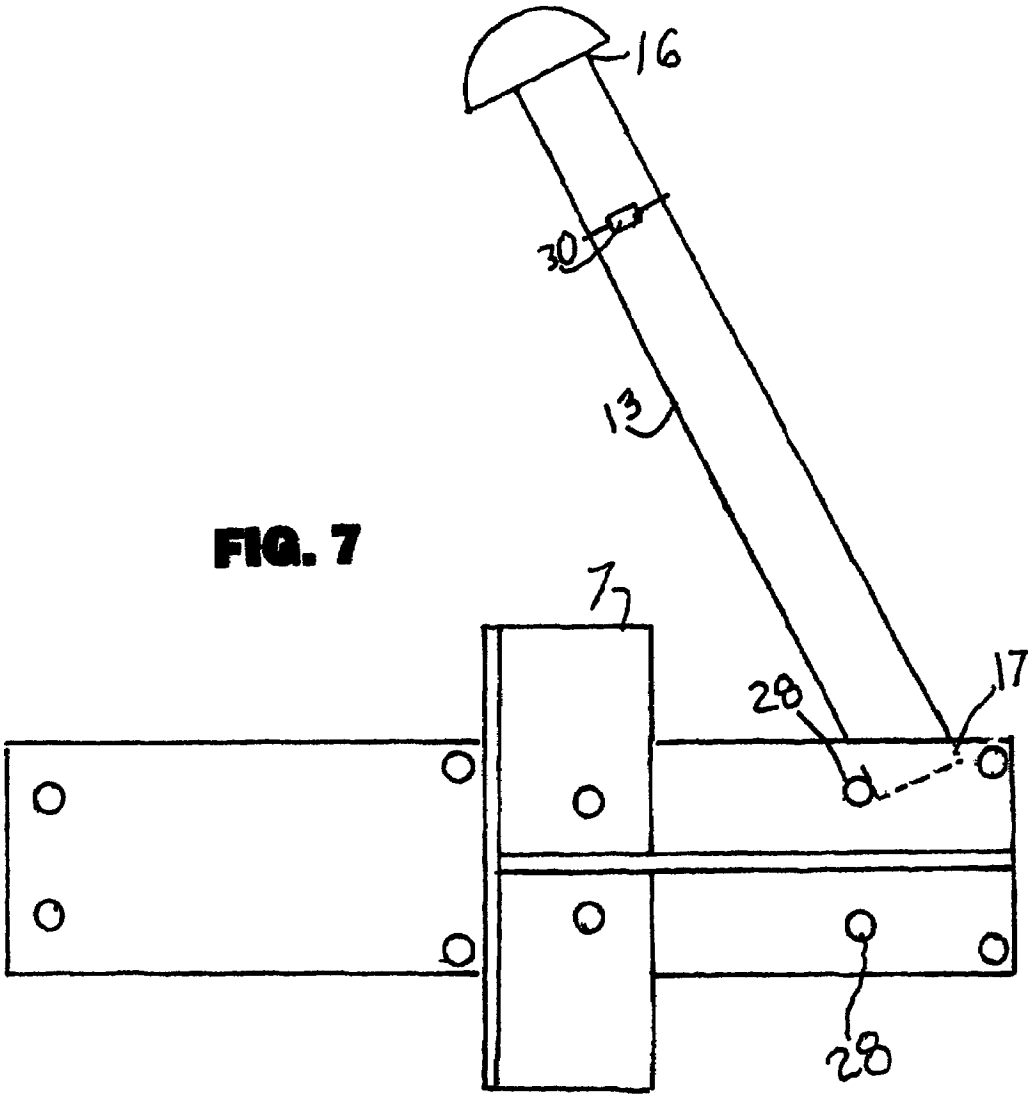
FIG. 7 is a top view of the assembly of FIG. 3 in maintenance position.

Referring now to FIG. 8, an embodiment of the invention 1' is shown that enables rotation to only one side. This is not a problem, since it will be installed where applicable, and another one with opposite rotation will be used where required. The elongate tubular member 13' has through holes 29' and 29" affixed along one side 14'. An axle bolt 18' passes through aperture 27 in support 7' and through hole 29' to serve as an axle for rotation in a counterclockwise direction to put the fixture 2 adjacent the catwalk for maintenance. When a locking fastener is passed through aperture 27" and through hole 29", the member 13' is fixed in the extended position. These fasteners are a control means for controlling rotation fixing of the member. They are within reach of a worker on the catwalk.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying ideas or principles of the invention.

The invention claimed is:

1. An illumination assembly for mounting a light fixture spaced apart a fixed first distance and position from a vertical surface to be illuminated, the surface mounted in a rigid frame including a catwalk and an electric power conductor, the assembly comprising:

fastening means for affixing the assembly to the catwalk;

an upper element extending out beyond the catwalk a second distance;

a lower element affixed to the upper element parallel thereto, and below the upper element to define a first space therebetween;

an elongate tubular member having a distal first end for affixing the light fixture thereto with an internal passage for electric wire for connecting the light fixture to the electric power conductor;

the tubular member having a proximal second end pivotally mounted within the first space by a first vertical member that is connected to the upper and lower elements and passes through the second end to enable the tubular member to rotate pivotally about the first vertical member in a horizontal arc between a first position in which the light fixture is at the fixed first distance and position to illuminate the surface and a second position in which the light fixture is adjacent the catwalk for servicing by a worker on the catwalk;

a second vertical member that is releasably connected to the upper and lower elements and passes through the second end to provide a means for releasably preventing rotation of the tubular member while in the first position; and the means for releasably preventing rotation being accessible to a worker on the catwalk.

2. The assembly of claim 1 in which the first and second vertical members pass through spaced apart passages on opposite sides of the tubular member.

3. An illumination assembly for mounting a light fixture spaced apart a fixed first distance and position from a vertical surface to be illuminated, the surface mounted in a rigid frame including a horizontal catwalk and an electric power conductor, the assembly comprising:

fastening means for affixing the assembly to the catwalk;

an upper element extending out beyond the catwalk a second distance;

a lower element affixed to the upper element parallel thereto, and below the upper element to define a first space therebetween;

an elongate tubular member with an internal passage for electric wire and having a distal first end for affixing the light fixture thereto;

the tubular member having a proximal second end pivotally mounted within the first space by a first vertical member that is passes through the upper and lower elements and passes through a passage in the second end to enable the tubular member to rotate pivotally about the first vertical member in a horizontal arc between a first position in which the light fixture is at the fixed first distance and position to illuminate the surface and a second position in which the light fixture is adjacent the catwalk for servicing by a worker on the catwalk;

a second vertical member that is releasably connected to the upper and lower elements and passes through a passage in the second end to provide a means for releasably preventing rotation of the tubular member while in the first position;

the passages for the first and second vertical members being on opposite sides of the tubular member; and the means for releasably preventing rotation being accessible to a worker on the catwalk.

* * * * *